US008690431B2

(12) United States Patent
Hughes

(10) Patent No.: US 8,690,431 B2
(45) Date of Patent: Apr. 8, 2014

(54) PACKAGING WITH LINES OF WEAKNESS

(75) Inventor: Douglas Vaughn St. Clair Hughes, Warwickshire (GB)

(73) Assignee: Mondelez UK Holdings & Services Limited, Uxbridge (GB)

( * ) Notice: Subject to any disclaimer, the term of this patent is extended or adjusted under 35 U.S.C. 154(b) by 707 days.

(21) Appl. No.: 12/438,569

(22) PCT Filed: Sep. 3, 2007

(86) PCT No.: PCT/GB2007/003316
§ 371 (c)(1),
(2), (4) Date: Feb. 24, 2009

(87) PCT Pub. No.: WO2008/029106
PCT Pub. Date: Mar. 13, 2008

(65) Prior Publication Data
US 2009/0190866 A1 Jul. 30, 2009

(30) Foreign Application Priority Data
Sep. 4, 2006 (GB) ..... 0617275.3

(51) Int. Cl.
*B65D 33/00* (2006.01)
*B65D 65/26* (2006.01)

(52) U.S. Cl.
USPC ..... 383/209; 383/207; 383/208; 383/205; 383/200; 220/87.05

(58) Field of Classification Search
USPC ..... 383/207, 200, 209, 205, 203, 905, 116, 383/208; 229/87.05, 237; 220/270
See application file for complete search history.

(56) References Cited

U.S. PATENT DOCUMENTS

| | | | | |
|---|---|---|---|---|
| 2,141,252 | A * | 12/1938 | Prindle | 229/87.05 |
| 3,618,850 | A * | 11/1971 | Palmer | 383/204 |
| 3,909,582 | A * | 9/1975 | Bowen | 219/121.69 |
| 4,834,245 | A | 5/1989 | Ohga et al. | |
| 5,158,499 | A * | 10/1992 | Guckenberger | 206/524.2 |
| 5,184,771 | A * | 2/1993 | Jud et al. | 229/87.05 |
| 5,897,052 | A * | 4/1999 | Tanaka et al. | 229/205 |
| 6,427,420 | B1 * | 8/2002 | Olivieri et al. | 53/412 |
| 6,860,843 | B2 * | 3/2005 | Hayashi et al. | 493/56 |
| 2004/0228549 | A1 * | 11/2004 | Wu | 383/207 |

FOREIGN PATENT DOCUMENTS

| | | |
|---|---|---|
| DE | 38 36 227 | 4/1990 |
| EP | 1 243 523 | 9/2002 |
| WO | WO 91/06488 | 5/1991 |
| WO | WO 92/15497 | 9/1992 |

* cited by examiner

*Primary Examiner* — Jes F Pascua
*Assistant Examiner* — Matthew Theis
(74) *Attorney, Agent, or Firm* — Hofmann & Baron, LLP

(57) ABSTRACT

The present invention provides a package (10) comprising an outer film layer (32) and at least one inner film layer (34,36), the inner and outer film layers being mutually laminated. The package also comprises a pair of mutually spaced lines of weakness (20) in at least the outer film layer, and means (22) for initiating tearing of the film layers. The lines of weakness and tear initiation means are disposed such that activation of the tear initiation means causes controlled tearing of all the film layers along the lines of weakness. The package is particularly suitable for block products such as chocolate bars.

15 Claims, 2 Drawing Sheets

PACKAGING WITH LINES OF WEAKNESS

CROSS-REFERENCE TO RELATED APPLICATIONS

This application is the National Stage of International Application No. PCT/GB2007/003316, which designates the U.S., filed Sep. 3, 2007, which claims the benefit of GB 0617275.3, filed Sep. 4, 2006, the contents of which are incorporated by reference herein.

FIELD OF THE INVENTION

The present invention relates to easy-open packages for products, such as food products. More particularly, the present invention relates to easy-open packages for chocolate bars that can be easily opened and re-closed.

BACKGROUND OF THE INVENTION

Plastics sheeting or film is used to package a great number of products on modern packaging lines. Such packages may be made from relatively thin plastics film that may be either a single layer or multiple layers. Laminate films comprise layers of material such as thermoplastics, including polyethylene and polypropylene, paper or metal, including aluminium. An adhesion promoting layer is often introduced to allow deposition of a metal or to prevent problems associated with delamination. Ideally, the packaging material is as thin as possible for economic reasons whilst being sufficiently strong to withstand the packaging process and any subsequent mechanical stress, and still act as an effective barrier to prevent spoilage of the contents. The packaging material must be strong to prevent it opening prematurely but this may result in problems for the consumer because the package can be difficult to open without resort to cutting tools such as scissors or knives. If such tools are unavailable, the consumer may attempt to rip the package open or tear it with the teeth. The package is likely to tear open in a random direction, causing the contents to be spilled and often destroying the package so that it cannot be re-closed.

The problems associated with opening plastics packages are well known and various attempts have been made to overcome them. Often a notch is cut into the edge of the package so that tearing can be initiated from that point.

However, the consumer may need to use considerable force to tear the package and, more importantly, the direction of tearing cannot be controlled. This method is often employed for single use products such as sachets of shampoo or ketchup because the package cannot be easily re-closed once it has been opened. One method of controlling the direction of the tear is to embed a tear strip in the package. This is seen, for example, in wrappers for cigarette packs and bars of soap. A ribbon of material is wrapped around the product and adhered to the package, usually leaving a small excess of ribbon to protrude and act as a pull-tab. The consumer simply pulls the tab so that the ribbon of material unwinds and tears the packaging in the same direction. This solution is effective but costly since it requires additional materials and a more complicated packaging process, thereby raising production efficiency problems. A further solution is to include a plastics zipper within the package. This allows the package to be opened and closed easily but greatly increases the cost.

SUMMARY OF THE INVENTION

It is an object of the present invention to provide an improved packaging.

According to a first aspect of the present invention, there is provided a package comprising an outer film layer and at least one inner film layer, said inner and outer film layers being mutually laminated, characterised in that the package comprises a pair of mutually spaced lines of weakness in at least the outer film layer, and means for initiating tearing of the film layers, said lines of weakness and tear initiation means being disposed such that activation of the tear initiation means causes controlled tearing of all the film layers along the lines of weakness.

Preferably the lines of weakness are not present in all of the film layers, thereby not deleteriously affecting the sealing of the package. i.e. the contents of the package are not exposed to external contaminants.

Preferably the lines of weakness are in the outer layer only, thereby not deleteriously affecting the sealing of the package.

The outer film layer is preferably a plastics material, more preferably a thermoplastics material, even more preferably polyethylene, polypropylene or polyester and most preferably polypropylene.

The thickness of the outer layer is preferably between 10 and 50 micrometers, more preferably between 15 and 30 micrometers and most preferably between 18 and 21 micrometers.

The at least one inner film layer is preferably a metallic material, more preferably aluminium. The thickness of the at least one inner film layer is preferably between 5 and 15 micrometers.

The number of inner layers is theoretically unlimited. However one or two inner layers are preferred. In the case of two inner layers, the innermost layer is preferably a plastics material (e.g. polypropylene) and the other (i.e. the intermediate) layer is a metallic material (e.g. aluminium).

The lines of weakness may be perforations or score lines or a combination of both. The lines of weakness may be formed mechanically or by a laser. The lines of weakness are preferably formed using a laser.

The pair of mutually spaced lines of weakness may be straight or curved and may or may not be parallel. However, the pair of mutually spaced lines of weakness are preferably straight and parallel. The mean distance between the mutually spaced lines of weakness is preferably between 4 and 40 mm, more preferably between 6 and 30 mm, even more preferably between 8 and 20 mm and most preferably between 10 and 15 mm.

The tear initiation means may be adhered to the package or may be integrally formed from the film layers. The tear initiation means is preferably formed by two cuts through all of the film layers, each cut meeting one of the mutually spaced lines of weakness, thereby forming a pull-tab. It will be understood that tearing is initiated by pulling on the tab which in turn causes the package to tear along the lines of weakness.

In a particularly preferred embodiment, a seal is formed by adhering overlapping ends of the laminate film together, leaving a small gap in the region where the tear initiation means is to be formed. The tear initiation means in the form of a pull-tab is formed by a pair of closely spaced cuts (notches or nicks) in the seal. This arrangement is conveniently embodied by a fin seal. The overlapping ends once adhered define a fin or flap which runs the length of the package, usually along a major surface thereof. Sealing of the package is completed with a seal at each end of the fin seal. It will be understood that for a rectangular package, the end seals will be mutually parallel and perpendicular to the fin seal. A fin seal so formed can be folded flat against the package thereby preventing accidental snagging. Preferably, the lines of weakness are perpendicular to the fin seal (i.e. parallel to the end seals in a rectangular package).

Where one of the inner film layers is a metallic layer, there is an added advantage that the package can be easily re-closed simply by folding. Laminate films comprising metallic layers have excellent deadfold characteristics (i.e. the fold is self maintained). In contrast, plastics layers in particular will generally spring back after folding and so do not form satisfactory seals. In the presence of the metallic layer, potential springback is prevented which is particularly useful when the outer layer is a plastics material.

The package of the present invention may be used to package a great many types of product but it is especially useful for block/slab products edible or otherwise. Preferred food products include confectionery, particularly chocolate bars, powder for beverages, bakery products, sugar confectionery, chewing gum and ice-cream, most preferably chocolate bars.

BRIEF DESCRIPTION OF THE DRAWINGS

An embodiment of the invention will now be described by way of example only with reference to the accompanying drawings in which.

DETAILED DESCRIPTION OF PREFERRED EMBODIMENTS

Figure 1A:
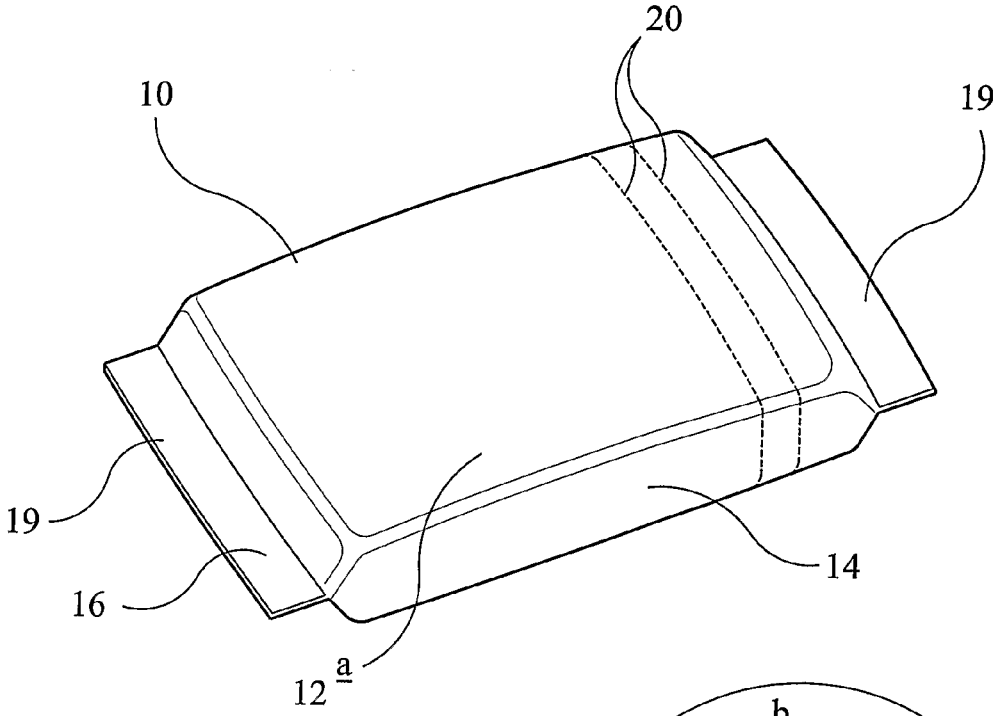
FIGS. 1*a* and 1*b* are perspective views of the top and bottom respectively of a package according to the invention.
Figure 1B:
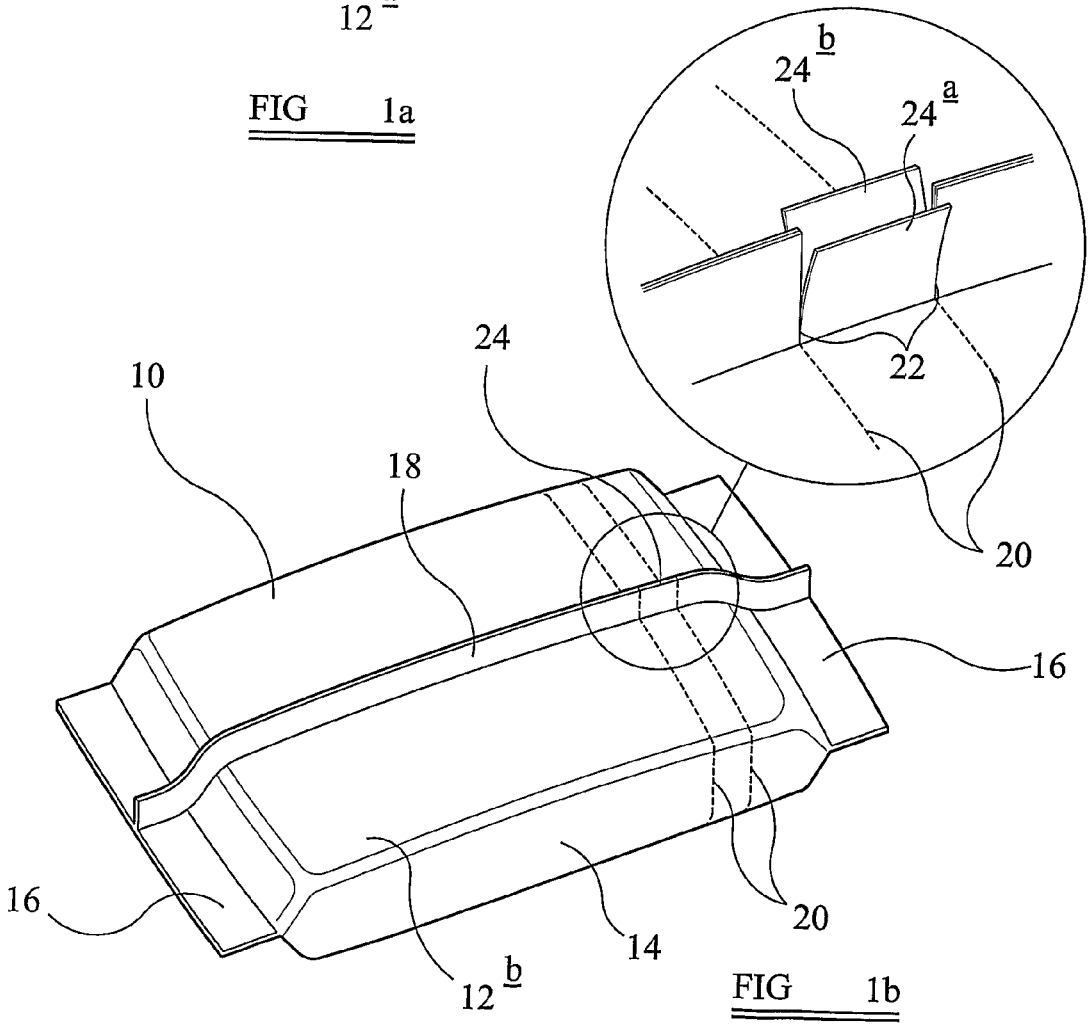

FIGS. 1*a* and 1*b* show a wrapped block of chocolate. The wrapping (package) 10 is formed from a laminate film which will be described in more detail with respect to FIG. 2 below. The wrapping is basically cuboid in shape, thereby defining top 12*a* and bottom 12*b* major surfaces, two minor edge surfaces 14, and two ends 16. The laminate film overlaps to form a long cold seal 18 commonly known as a "fin seal" which extends along the entire length and centrally of the bottom major surface 12*b*. Each of the ends 16 of the wrapping 10 is sealed with an additional short cold seal 19 so as to seal the chocolate. It will be understood that a cold seal is one which is formed using a pressure sensitive adhesive without heat. However, other sealing methods could be used. For example, if the inner layer is a thermoplastics material, sealing can be effected without additional adhesive by applying heat and pressure such that the inner layer adheres to itself. A pair of mutually spaced score lines 20 that are straight and parallel are located toward one end of the wrapping 10. The score lines 20 are formed using a laser and are present in the outer layer of the laminate film only so as not to compromise the wrapping seal. The score lines 20 extend from one side of the long cold seal 18, around the wrapping, to the opposite side of the long cold seal 18. The score lines 20 are approximately parallel to the ends 16 of the wrapping 10. A pair of cuts or nicks 22 is provided in the long cold seal 18, the cuts 22 are aligned with and meet the ends of the score lines 20 and constitute a tab 24 by which the wrapping 10 can be opened. The overlapping laminate film in the region between the cuts 22 is not sealed together so that the pull-tab 24 has two separate arms 24*a*, 24*b*. It will be understood that the score lines 20 in the outer layer control the direction of tear of the inner layers.

Figure 2:
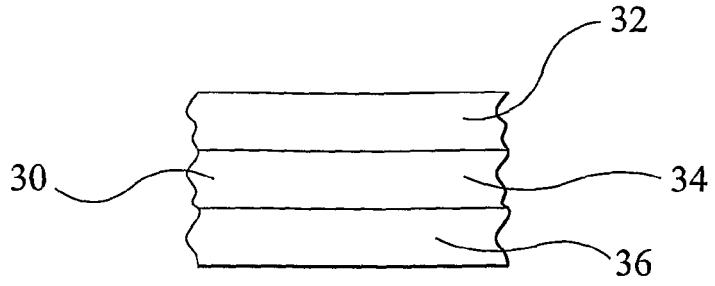
FIG. 2 is a cross-section view of a laminate film that is used in the production of the package shown in FIGS. 1*a* and 1*b*.

Referring to FIG. 2, the laminate film 30 consists of three layers; an outer layer 32 and two inner layers 34, 36. The outer layer 32 and innermost inner layer 36 are polypropylene layers. The other inner layer 34 (the intermediate layer) is an aluminium layer.

The laminate film 30 can be manufactured in the following manner. The innermost layer 36 is first laminated to the intermediate layer 34 with the use of an adhesive. The outer layer 32 is then reverse printed with any decoration and product information as necessary before being adhered to the intermediate layer 34. If a two layer laminate is required, reverse printing may not be suitable. Instead, the outermost layer can be surface printed and a release lacquer applied to protect the printing. Once the laminate film 30 is manufactured, a laser (ROFIN) is used in the range of 30 to 50 Hz to form the score lines 20 and the pair of cuts 22. The laser must be operated in the upper range to form the cuts 22 and lower range to form the score lines 20. The laminate film 30 can be manufactured, printed and laser etched before reaching the packaging plant. This means that the package of the present invention can be produced and filled very efficiently as is required on modern packaging lines In use, tearing along the score lines 20 is initiated when the consumer pulls on one of the arms of the tab 24. This causes a ribbon of the film 30 to be torn from the wrapping 10 in a controlled manner along the score lines 20 and allows easy-access to the contents of the package.

The laminate film 30 has excellent deadfold characteristics so it can be folded to reseal the wrapping 10. For example, once a portion of the chocolate has been consumed, the open end of the package can be folded over towards the still closed end of the package thereby effecting a temporary seal substantially parallel to the ends of the package.

Figure 3A:
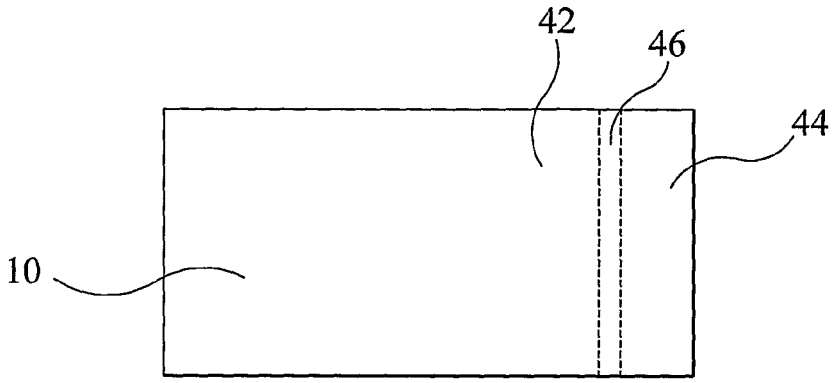
FIGS. 3*a* and 3*b* are top views of a package according to the invention.
Figure 3B:
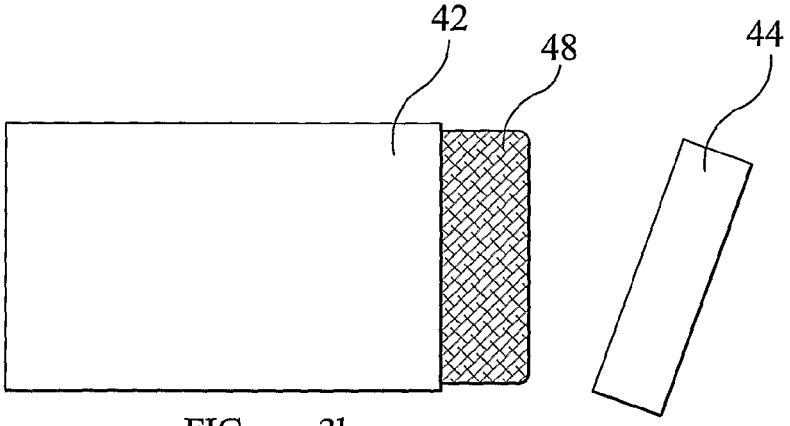

A simplified schematic of the packaging of FIG. 1 is shown in FIG. 3*a*. The package 10 can be considered to comprise a major section 42 and a minor section 44 disposed on opposite sides of an opening means 46. FIG. 3*b* shows the package 10 once it has been opened to reveal part of the contents 48 (a chocolate bar). The major section 42 serves as a container and the minor section 44 serves as a lid. The opening means 46 is discarded.

An advantage of the package of the present invention is that the package 10 can be completely filled because it may contain the desired contents on both sides of the opening means 46. In many prior art packages such as that described in WO01/64542, the package can be considered to comprise two sections: a storage section on one side of the opening means and an opening section on the other side of the opening means. The opening section must be discarded after opening so the whole volume of the package is not used efficiently. This advantage of the present invention makes is particularly useful for packaging tightly wrapped confectionery articles such as chocolate bars.

Figure 4:
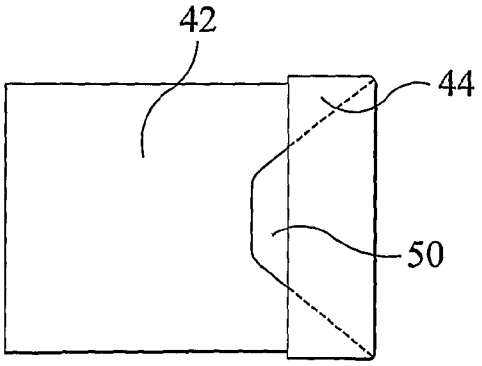
FIG. 4 is a top view of package according to the invention that has been opened and re-closed.

As already described and shown in FIG. 4, an advantage of the present invention is that the package can be re-closed once a portion of the contents has been consumed. Part of the container section 42 can be folded back on itself to form a temporary seal and flap 50. Further, if desired, this seal can be secured by replacing the lid section 44 over the container portion 42 and the flap 50.

The invention claimed is:

1. A package having a pair of end seals and fin seal therebetween, comprising an outer film layer and at least one inner film layer, said inner and outer film layers being mutually laminated, wherein the package comprises a pair of mutually spaced lines of weakness in the outer film layer only, and means for initiating tearing of the film layers integrally formed from all of the film layers, said tear initiation means being formed by two cuts through all of the layers of film, each cut being located within the fin seal and meeting one of the mutually spaced lines of the weakness, the entire region within the fin seal between the two cuts extending to one of the mutually spaced lines of weakness being unsealed defining a pair of tabs, said lines of weakness and tear initiation means being disposed such that activation of the tear initiation means causes controlled tearing of all the film layers along the lines of weakness.

2. The package of claim 1, wherein the outer film layer is a plastics material.

3. The package of claim 2, wherein the outer film layer is polypropylene.

4. The package of claim 1, wherein the thickness of the outer layer is between 10 and 50 micrometers.

5. The package of claim 1, wherein the at least one inner film layer is a metallic material.

6. The package of claim 5, wherein the at least one inner film layer is aluminum.

7. The package of claim 5 which once opened by said controlled tearing is re-closable by folding the film layers back on themselves, the resultant fold being self-maintained.

8. The package of claim 1, wherein the thickness of the at least one inner layer is between 5 and 15 micrometers.

9. The package of claim 1, wherein the package has exactly two inner layers, namely an innermost layer and an intermediate layer.

10. The package of claim 9, wherein the innermost layer is a plastics material and the intermediate layer is a metallic material.

11. The package of claim 1, wherein the lines of weakness are score lines.

12. The package of claim 1, wherein the mutually spaced lines of weakness are straight and parallel.

13. The package of claim 1, wherein the mean distance between the mutually spaced lines of weakness is between 4 and 40 mm.

14. The package of claim 1 which is rectangular, the end seals being along the short sides.

15. The package of claim 1, wherein the lines of weakness extend into the fin seal.

* * * * *